US010201216B2

(12) United States Patent
Van Geer

(10) Patent No.: US 10,201,216 B2
(45) Date of Patent: Feb. 12, 2019

(54) DEVICE FOR SEPARATED STORAGE OF CARDS AND MONEY

(71) Applicant: Rene Johan Van Geer, Rijswijk (NL)

(72) Inventor: Rene Johan Van Geer, Rijswijk (NL)

(73) Assignee: R.J. van Geer Beheer bv, Rijswijk (NL)

( * ) Notice: Subject to any disclaimer, the term of this patent is extended or adjusted under 35 U.S.C. 154(b) by 216 days.

(21) Appl. No.: 14/905,602

(22) PCT Filed: Jul. 19, 2014

(86) PCT No.: PCT/NL2014/050493

§ 371 (c)(1),
(2) Date: Jan. 15, 2016

(87) PCT Pub. No.: WO2015/009156

PCT Pub. Date: Jan. 22, 2015

(65) Prior Publication Data

US 2017/0202324 A1 Jul. 20, 2017

(30) Foreign Application Priority Data

Jul. 19, 2013 (NL) ..... 2011203
Jul. 16, 2014 (NL) ..... 2013197

(51) Int. Cl.
*A45C 1/06* (2006.01)
*A45C 11/18* (2006.01)

(52) U.S. Cl.
CPC ..... *A45C 1/06* (2013.01); *A45C 11/182* (2013.01); *A45C 2001/065* (2013.01); *A45C 2001/067* (2013.01)

(58) Field of Classification Search
CPC ..... A45C 11/182; A45C 2011/186; A45C 2001/065; A45C 2001/067; A45C 1/06
USPC ..... 150/147
See application file for complete search history.

(56) References Cited

U.S. PATENT DOCUMENTS

| | | | | |
|---|---|---|---|---|
| 5,275,217 | A | 1/1994 | Eakin | |
| 5,878,874 | A * | 3/1999 | Weggelaar | A45C 11/184 150/147 |
| 5,944,080 | A | 8/1999 | Podwika | |
| 6,823,910 | B1 | 11/2004 | Elnekaveh | |
| 7,830,672 | B1 | 11/2010 | Kitchen | |
| 2007/0262112 | A1 | 11/2007 | Butler et al. | |
| 2011/0277892 | A1 | 11/2011 | Black | |

FOREIGN PATENT DOCUMENTS

| | | | |
|---|---|---|---|
| WO | 97/06709 | A1 | 2/1997 |
| WO | 2010/137975 | A2 | 12/2010 |

OTHER PUBLICATIONS

International Search Report, dated Jan. 13, 2015, from corresponding PCT application.

* cited by examiner

*Primary Examiner* — Sue A Weaver
(74) *Attorney, Agent, or Firm* — Young & Thompson

(57) ABSTRACT

Object including a card holder for cards and a money holder for money, wherein the card holder has a card storage space for a stack of one or more cards and the money holder has a money storage space for money, wherein the money storage space is designed such that the money is stored loosely and the money holder has a for the money designed money access opening to the money storage space which with a part of the object, preferably the card holder, can be closed to prevent passage of money.

10 Claims, 10 Drawing Sheets

DEVICE FOR SEPARATED STORAGE OF CARDS AND MONEY

BACKGROUND OF THE INVENTION

The invention relates to a holder for separated storage of money and credit cards, bank cards and different objects having dimensions similar to credit cards, in this specification also called "cards". "Money" here means coins and/or bank notes. The device is also designed for alternatives for money, e.g. condoms or tickets.

For the so called credit card format the main dimensions suffice ISO 7810 and the thickness and roundings suffice ISO 7813. This format is applied for many cards with a diversity of applications: bank cards, driving licenses, ID-cards, membership cards, entry tickets, reduction cards, savings cards, etc.

The cards preferably have a solid, not foldable shape and a smooth, slippery, friction free surface.

U.S. Pat. No. 5,944,080 discloses a holder assembled from a plate with the size of approximately a credit card, which flat plate has at the one side a transverse groove in the surface and spaced from it an against the plate pressing, spring blade like clamping jaw. Inside the groove fits with tight fit a part of a wide elastic belt as a closed loop. The other part of the belt extends across the other side of the plate and the belt is stretched around the plate. Bank notes are stored loosely below the clamping jaw and cards are at the other side of the plate loosely inserted below the belt. Although this holder can store both many and few bank notes and cards, however unable to store these neatly for long time while in the pocket of a pants which has been put on. Due to movements during walking, standing up and sitting down, the bank notes and cards will slide relative to the plate and will disorder or can even become lost by the holder. The clamping jaw can cause damage to clothing and can hook behind some object while it is picked from and inserted into the pants pocket. This holder is thus unsuitable in use.

U.S. Pat. No. 6,823,910 discloses a holder assembled from a flat huls offering a tightly fitting storage for a stack of cards, and at its outer side a with a spring provided clamping jaw pressing against the huls and which clamps bank notes. Thus the bank notes can easily become in disorder.

WO9706709 (bodycard) and WO2010137975 (cardprotect) both disclose a merely for the storage of cards designed holder made from a flat sleeve offering a tightly fitting storage for a stack of cards.

SUMMARY OF THE INVENTION

An object of the invention is a device with one or more of the following aspects: simple and easy to use; error free handling; compact if filled with different numbers of cards and money; safe for clothing and skin; separately storing cards and money neatly during longtime within the pocket of a trousers which is put on; light weight; long life; fixed shape and thus a safe protection for cards and bank notes; invisible storage of cards and bank notes; separate storage of bank notes and cards; produced at low costs; attractive appearance; can store both a single card or bank note and many cards and bank notes; can show the same visible message if empty and filled with cards and bank notes; its appearance can be individualized. One or more of the above or somewhere else discussed or from the prior art stemming objects or drawbacks are at least partly obtained or solved by the invention.

The device of the invention is characterized by claim 1.

The elastic spring means and/or money holder or cardholder can be easily replaced to adapt the appearance of the device to the life style of the user.

Preferably one or more of the following applies to the device: the card and money storage space and/or the card and money holder have a rectangular shape, preferably elongated; the card and money holder have a fixed shape, robust, of light weight material, e.g. metal or polymer material, polyester, PP; the card and money holder are mutually independent parts; the card and money holder can pivot towards and away from each other against pre tension (of a urging means of the device), preferably wherein by pivoting away from each other the money access opening is opened; the card and money holder, or inner wall of it, are box or sleeve shaped; the card storage space receives a cards stack with tight fit; the pivot axis extends transverse to the length; sliding is parallel to the length; sliding is allowed in one direction only by restraining means of the invention; the card and money storage space are mutually separated by a wall of the device, preferably of the card holder; the longitudinal directions of the card and money storage spaces are parallel; the pivot axis is present at or near and end; an elastic urging means, e.g. closed loop, preferably wide belt, e.g. van rubber band, encircles the device and/or is applied slide free (e.g. by virtue of tight fit, e.g. due to engagement with a projection or recess) to, preferably around, the one and slidable (e.g. by friction free engagement) to, preferably around, the other holder (this effect could also be obtained if the friction engagement of the one holder is substantially higher compared to the other holder), wherein the other holder preferably merely by overcoming the engagement force with the urging means is slidable; the urging means extends transverse to the longitudinal direction of the device; the urging means is located remotely from both longitudinal ends of the device; comprises a flat plate with the money storage space at the one side and the card storage space at the other side; the money access opening and the card access opening to get access to the card storage space are located at the same side of the device; the card or money holder are merely by friction or interference fit kept in place (e.g. longitudinally or in the direction of inserting a card into the card holder) at the device; the card or money holder can slide by exerting a (e.g. longitudinal) force in direction of sliding, which overcomes the friction or interference fit; the card or money holder is retained in the one slide direction by a stop at the device; the parts of the outer side of the card or money holder in engagement with the urging means, are completely smooth and slippery and friction free; if the urging means is absent, the card and money holder are loosely stacked mutually; the card or money holder is located between transverse movement preventing stops at the device; the card or money holder has the top or bottom wall at fixed mutual distance; the card and money holder have one or more of a fixed length, width and depth; the card holder has an ejector mechanism of the cards; the card and/or money holder provides an external wall; the card or money holder slides relative to the elastic loop; in each slide position of the card holder the card access opening is opened such that a card can be inserted; the retaining means, such as stop, to prevent sliding in the one direction, is present near the card and/or money access opening; the money storage space contains a plate, sheet, wall or foil shaped covering or money guiding means parallel to the card within the card holder such that money between this means and a wall of the money holder is received; the covering means extends substantially the complete width of the money storage space; the covering means is provided to move with the money holder, e.g. fixed to it; the covering means is next to the card holder and/or rests against a to it parallel wall of the card holder; the covering means is a separate part; the covering means has a length not more then 75% or 50% of the length of the money holder; the covering means has a to the money access opening facing edge region which diverts towards the card holder; the money or card holder has upright walls or wall parts between which the other holder is confined at three side; the card or money holder has remote from its bottom wall a parallel to the card extending support edge at both sides onto which the other holder bears; a retaining means at the money or cardholder to limit sliding in a direction engages the front of the other holder, e.g. the edge of the access opening; the card and money holder have an equal or substantially equal length.

The cover means prevents that contents of the money holder becomes clamped while opening the money holder, however does not block the free access to the money holder is being slid open.

The external side of the one holder has e.g. a retaining means, such as a projection or edge or a stop, e.g. part of a recess, with which a part of the elastic belt engages, which is provided as a closed loop around the device with elastic tension to press the parts of the device against each other and thus keep them together. The stop prevents free sliding of the loop in longitudinal direction relative to the one holder. The loop bears onto the surface of both parts. The loop is e.g. made of rubber. The fixing belt can be provided as a loop by mutually fixing the ends of a belt length. The fixing belt provides urging the parts towards each other.

To keep the card and money holder mutually stacked, an individual can stretch the belt manually to enlarge the loop and insert the card and money holder into the stretched loop and subsequently release the belt such that the fixing belt retracts elastically such that the loop shrinks and spant around the card and money holder.

E.g. one or both mutually engaging surfaces of the elastic belt and the relative to it slidable card or money holder are sufficient smooth, slippery and friction free. E.g. one or both mutually engaging surfaces of the elastic belt and the relative to it slidable card or money holder are sufficient rough en non slippery with large friction.

The wording "parallel to the card" means "parallel to the main face of the card". The wording "card holder" or "money holder" can alternatively mean "device".

DETAILED DESCRIPTION OF THE INVENTION

Figure 1:
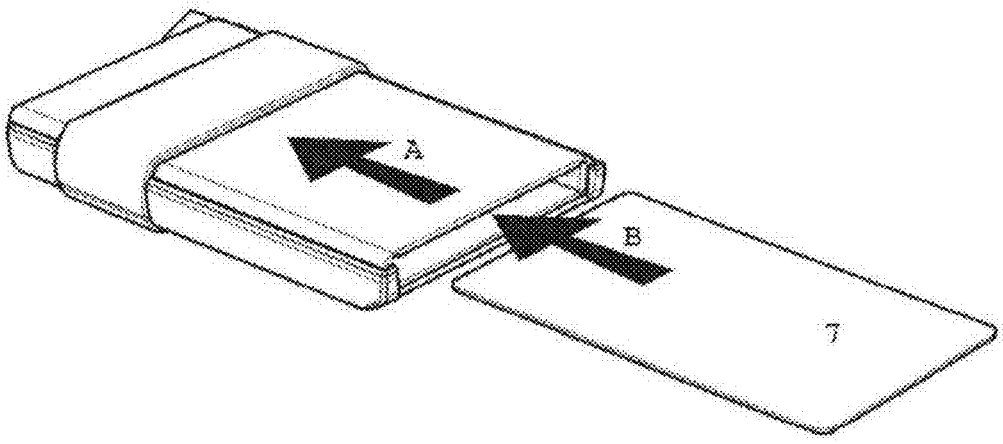
FIG. 1-15 show a preferred embodiment.
Figure 2:
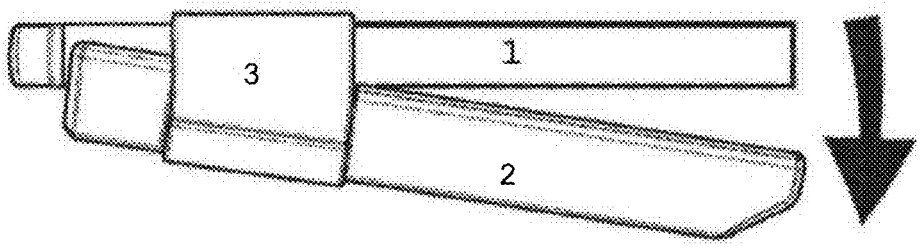
Figure 3:
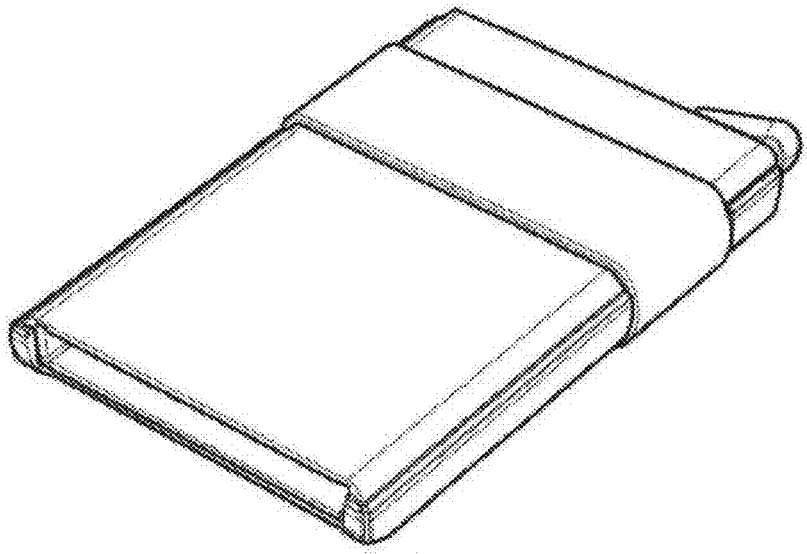
Figure 4:
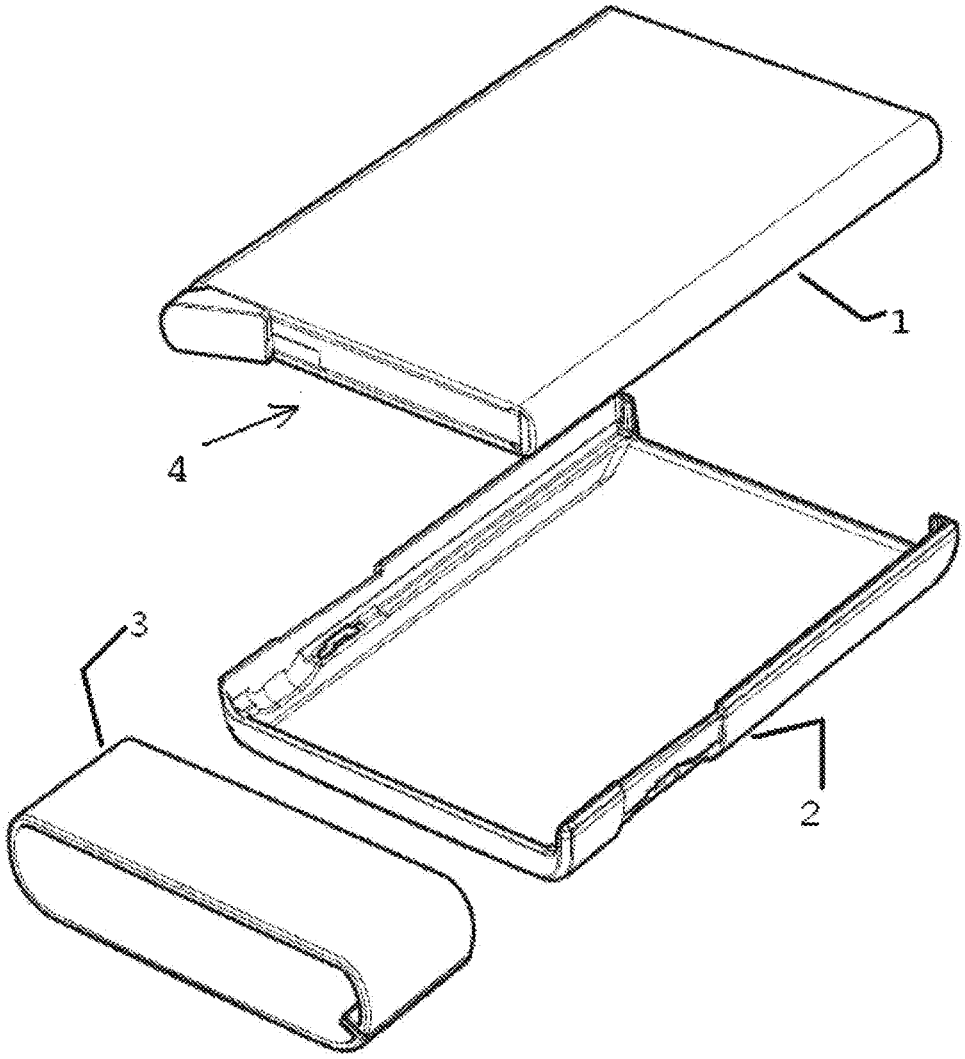
Figure 5:
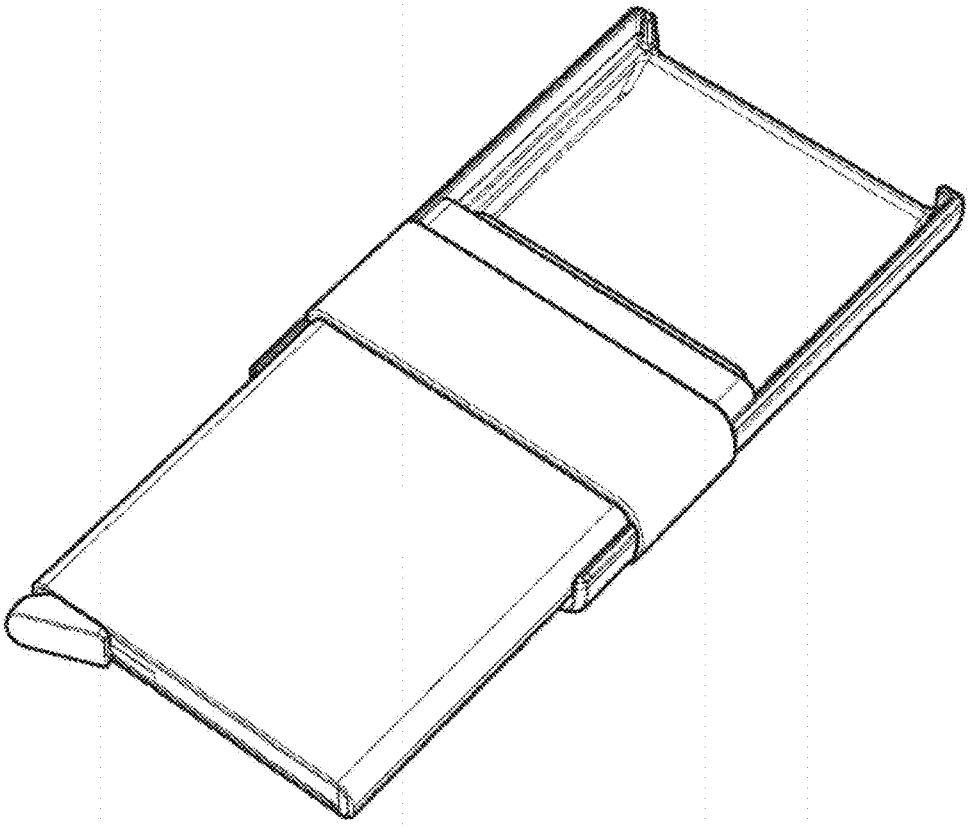
Figure 6:
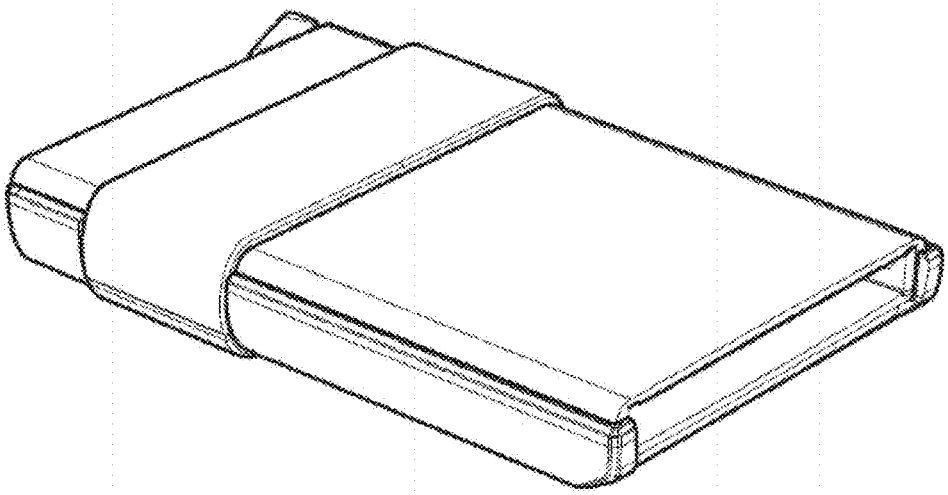
Figure 8:
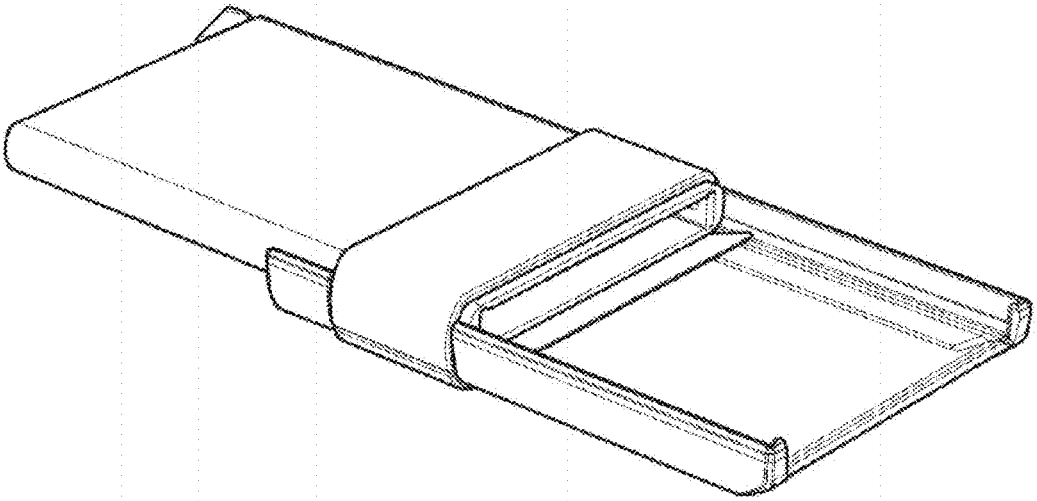
Figure 9:
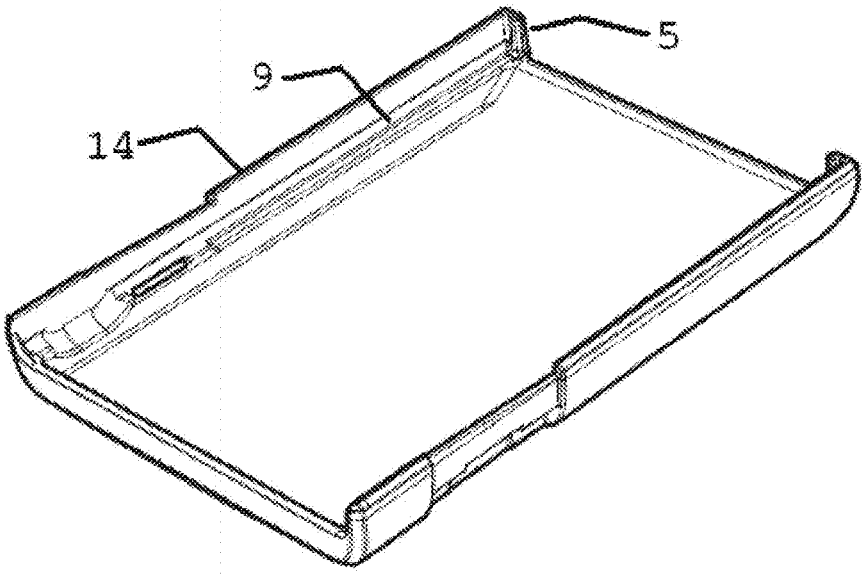
Figure 10:
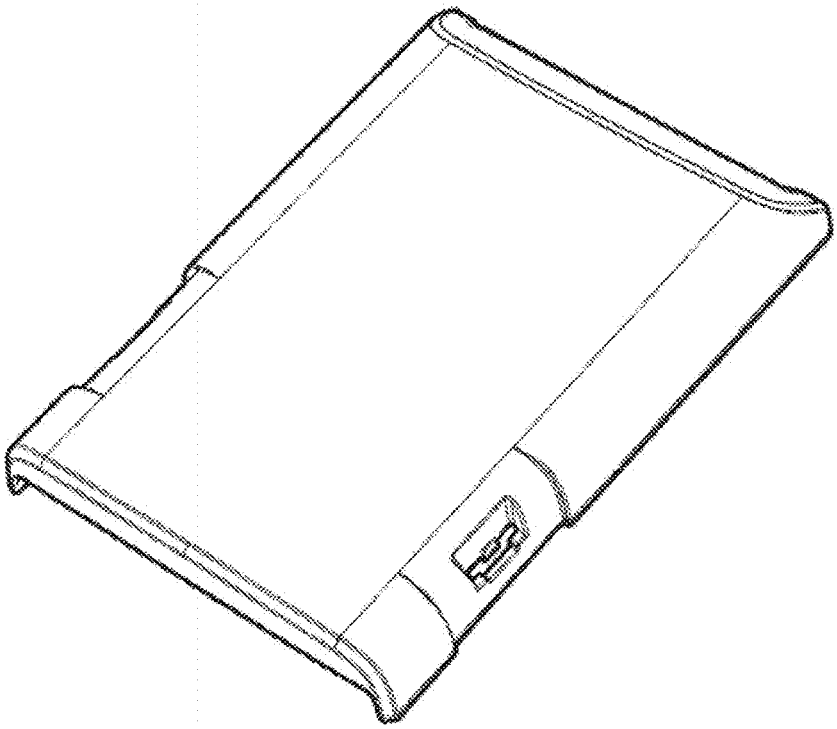
Figure 11:
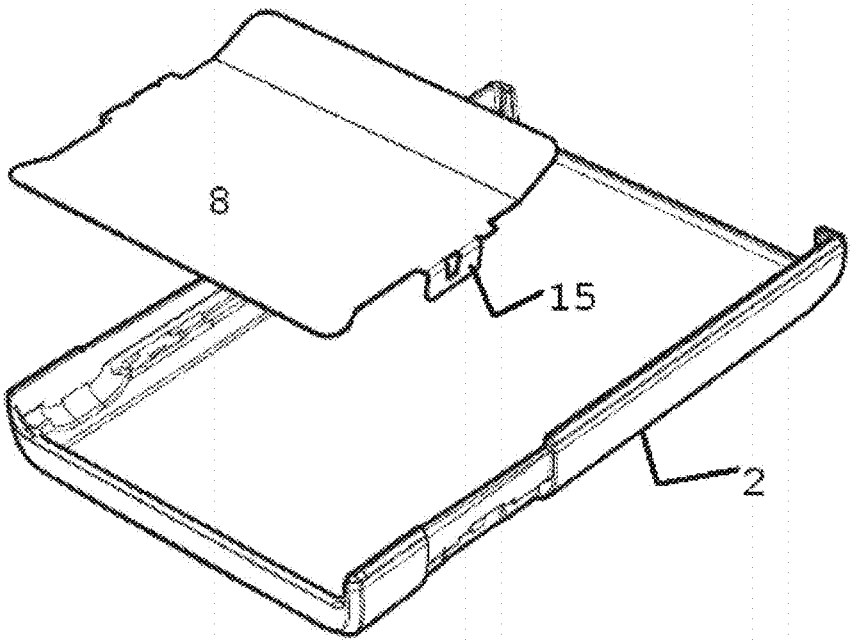
Figure 12:
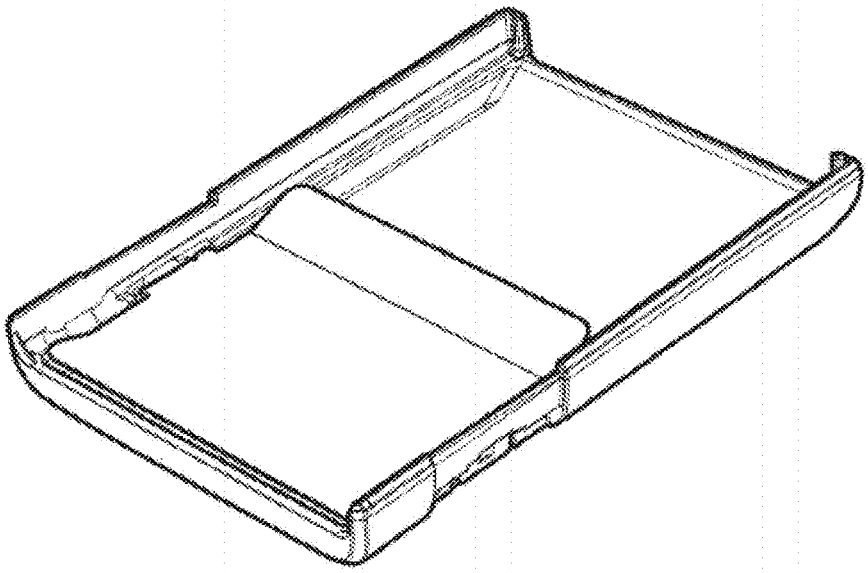
Figure 13:
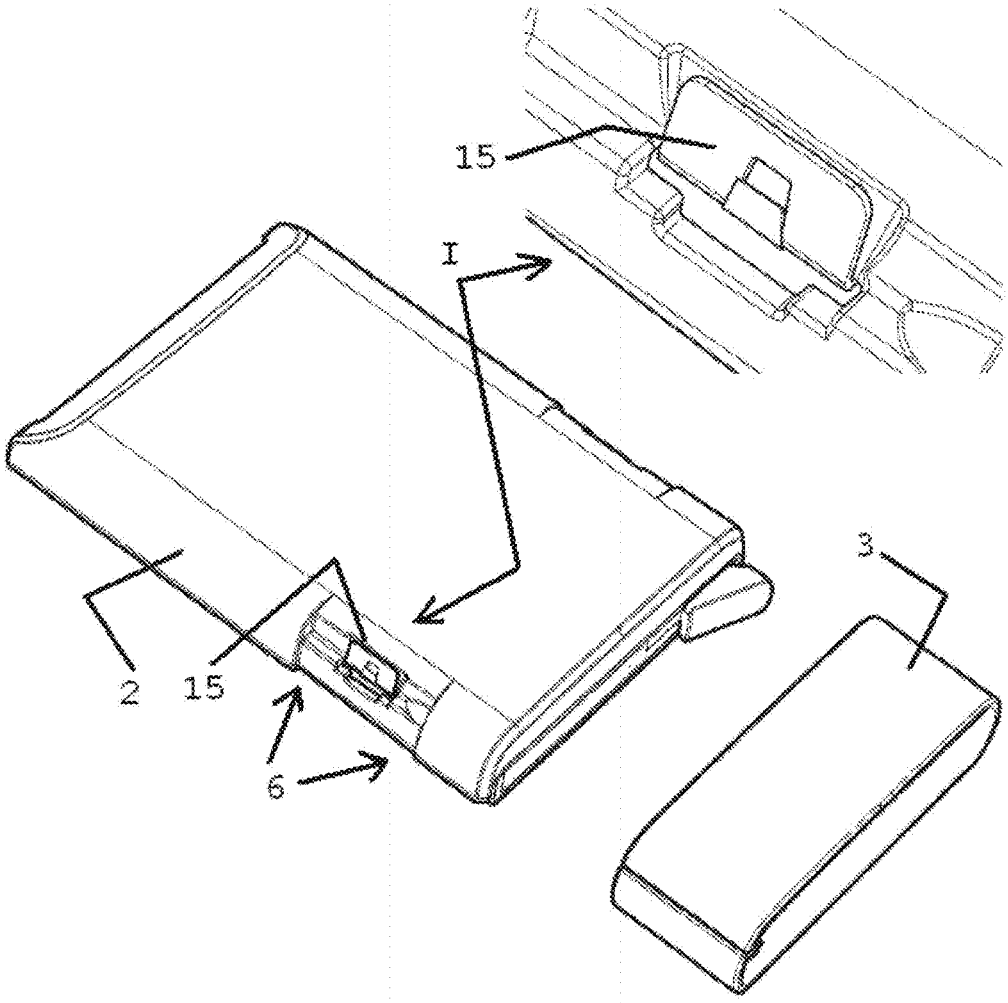
Figure 14:
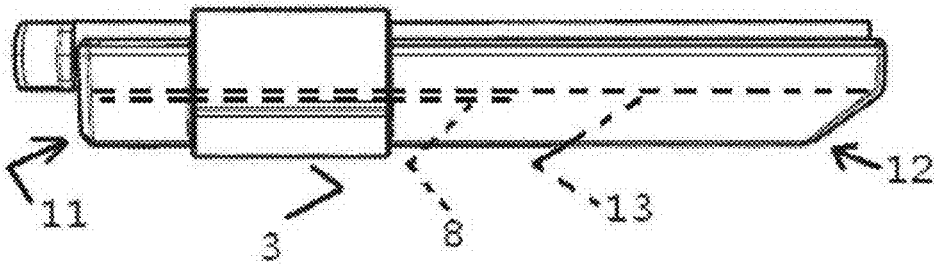

FIG. 1, 3-13, 18-21 are perspective, FIGS. 2 and 14 are side views, the other figures are sectional, FIGS. 4, 11 and 13 are exploded views. FIGS. 3, 6 and 14 show the device closed, FIG. 2 pivoted open, FIGS. 5, 7 and 8 slid open, FIGS. 9 and 10 show the money holder 2 separately.

The device of FIG. 1-15 comprises a card holder 1, a money holder 2 and a wide elastic 3 with closed loop. The holders 1, 2 are stacked onto each other and the rubber band 3 has an elastic stretched state around the holders 1, 2 which are thus by the loop 3 pressed onto each other. The parts 1, 2 and 3 are separate parts.

The card holder 1 is a flat, at one side open sleeve with an eject mechanism 4 at the opposite end, and is known as such from WO2010137975. A card 7 is inserted into the holder according to arrow B.

The money holder 2 is a tray with open top and a back wall 11 and a front wall 12 and raised side walls 14 having a supporting edge 9 at the level of the top edge of the walls 11, 12. The holder 1 bears with its lower side 13 onto the supporting edge 9 and tightly fits between side walls 14 above the edges 9. If the card and money holder 1, 2 of equal length are registered (FIG. 14) the card holder 1 joins the walls 11, 12 and 14 and thus closes the money storage space from above, and the walls 14 prevent that the card holder 1 can slide aside (arrow D in FIG. 15).

The loop 3 allows by further elastic stretching mutual pivoting (arrow C in FIG. 2) and also across the complete length moving away from each other (arrow E in FIG. 15) of the card and money holder, such that the money storage space is enlarged.

Figure 7:
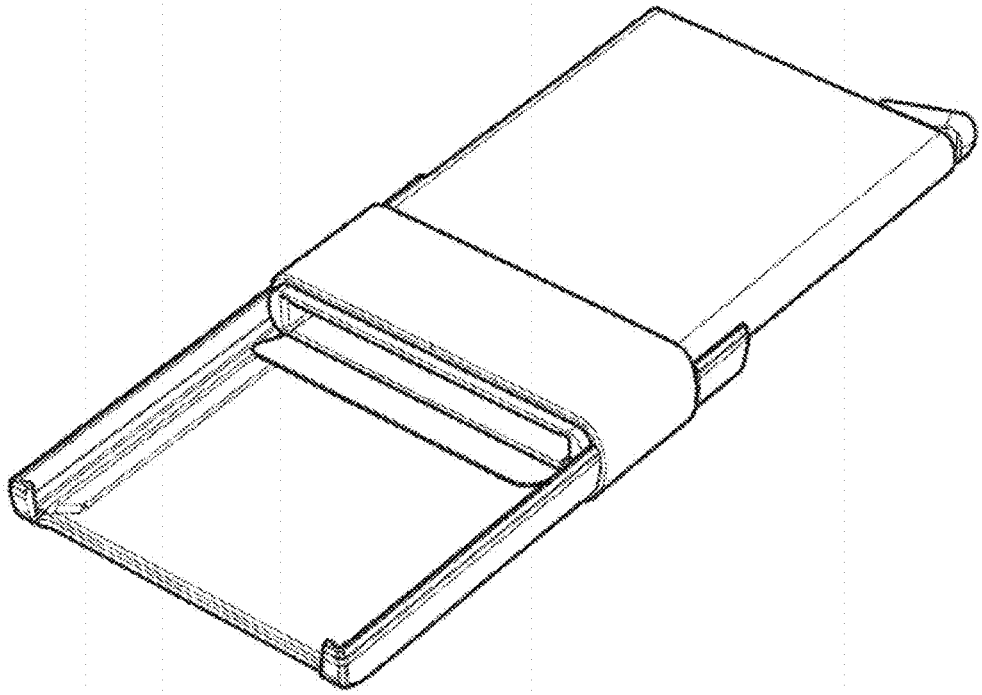

The loop 3 engages with edges 6 of a recess at both sides in the money holder 2 (in FIGS. 10 and 13 shown upside down), such that the loop 3 is fixed to the money holder 2 in lengthwise direction. The engagement of the loop 3 with the card holder is friction free, such that the card holder 1 can slide below the loop 3 lengthwise according to arrow A (FIG. 1) to open the money holder 2 (FIGS. 5, 7 and 8). Stops 5 prevent that from the location of FIG. 1 the card holder 1 can slide below the loop 3 opposite to arrow A. The stops engage at both sides of the card access opening to the open end of the card holder 1.

Figure 15:
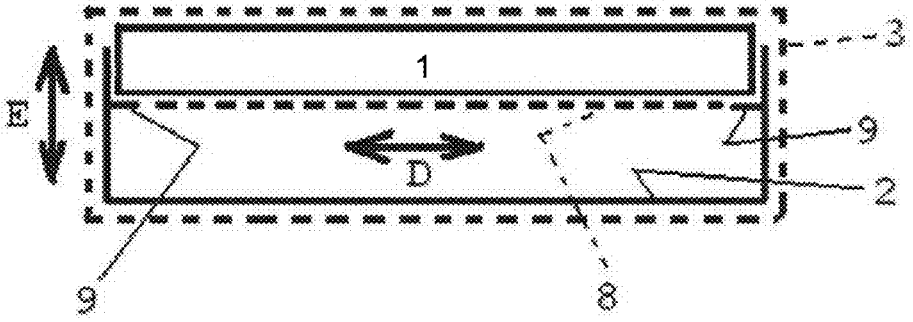

A money guiding means 8 (FIGS. 11 and 12, in FIGS. 14 and 15 shown in phantom) is present at the level of the edges 9 and provides a flexible bulkhead parallel to the card 7. FIG. 13 shows with detail I how a lip 15 of the foil 8 projects into a slit in the money holder 2 such that the foil 8 is fixed to the holder and follows the movement of the holder. The lip 15 is fixed to the holder by a snap engagement. The foil 8 provides a top wall of the holder 2 remote from the bottom of the holder 2 and extends the complete width and not more than half the length of the holder 2 and is present remote from the access opening to the holder 2. The contents of the holder 2 is present below the foil 8 in the position of the device when the money holder 2 is present below the card holder 1.

Figure 16:
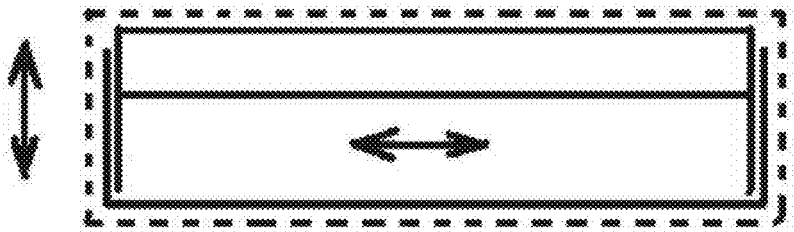
FIGS. 16 and 17 show alternatives for FIG. 1-15.
Figure 17:
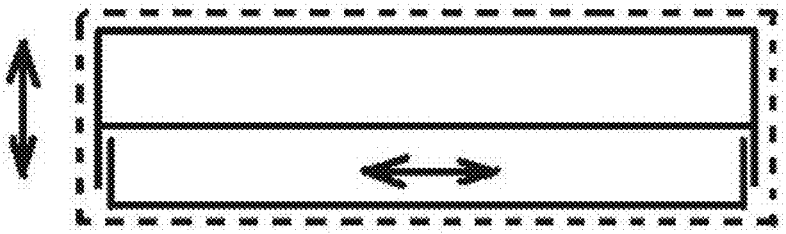

FIGS. 16 and 17 show alternatives to FIG. 15 wherein however the card holder needs adaption.

Figure 22:
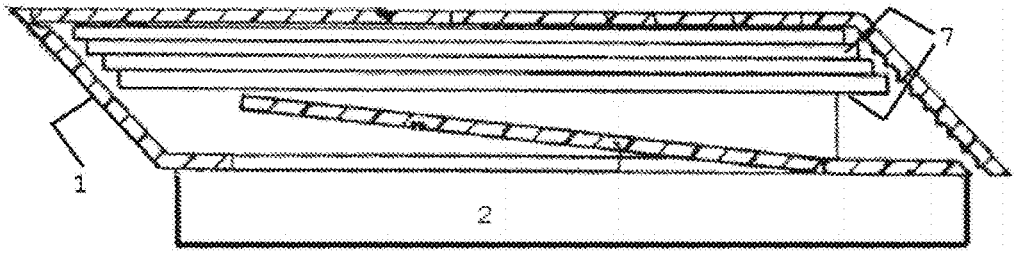
FIG. 22-24 show an alternative device.
Figure 23:
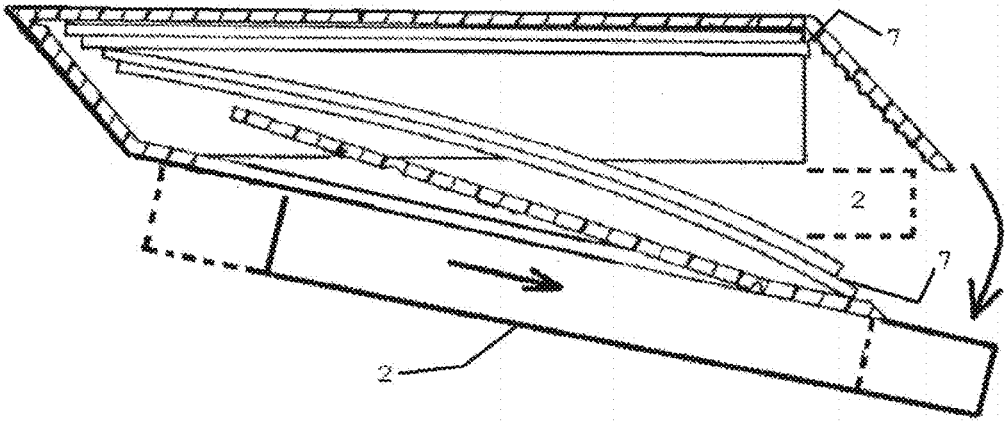
Figure 24:
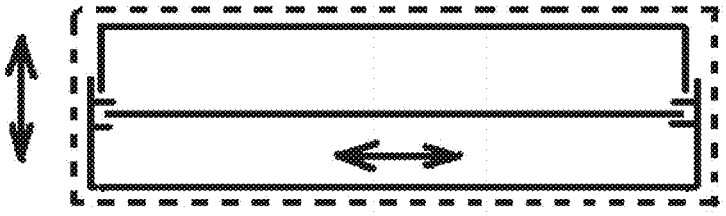

FIG. 22-24 show an alternative device, wherein the lower side 13 of the card holder can pivot open and the money holder can slide below the to the cardholder fixated loop (not shown). In FIG. 23 the money holder is slid open. FIG. 24 shows for the device of FIG. 22 the slidable fixation of the money holder.

Figure 25:
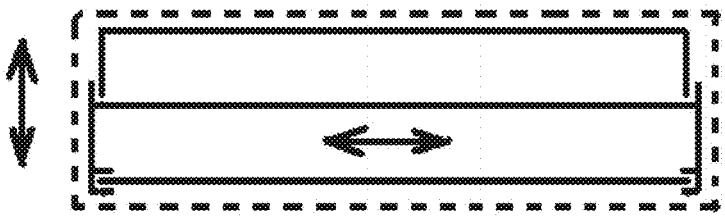
FIG. 25 shows an alternative for FIG. 24.

FIG. 25 shows an alternative for FIG. 24.

Figure 20:
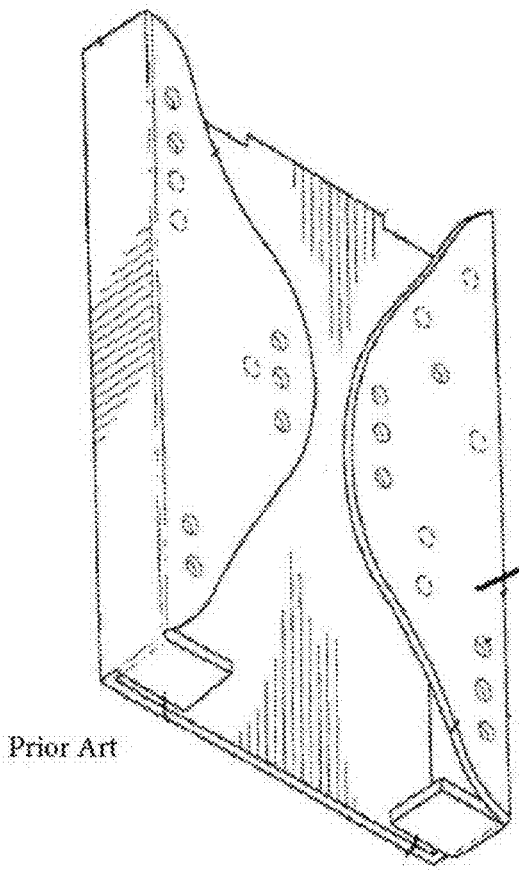
FIGS. 20 and 21 show alternative card holders.
Figure 21:
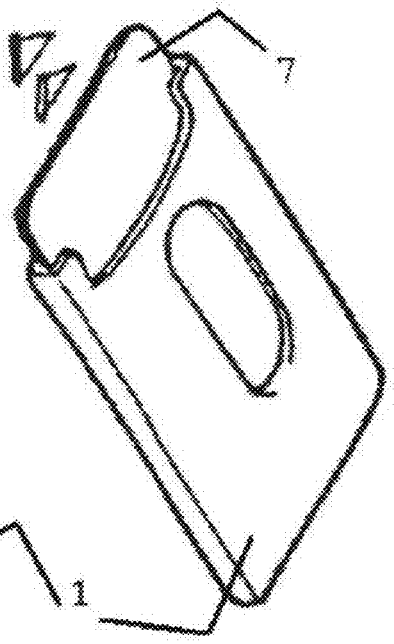

FIGS. 20 and 21 show for the device applicable alternative card holders which have in the top side an access opening to the card storage space, such that by the thumb of a hand a card can be slid from the card holder and thus an eject mechanism 4 can be absent.

Figure 18:
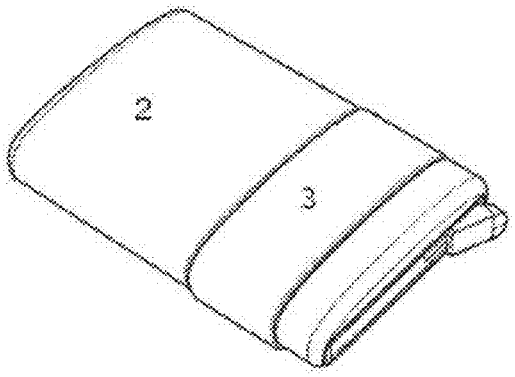
FIGS. 18 and 19 show a different embodiment type.
Figure 19:
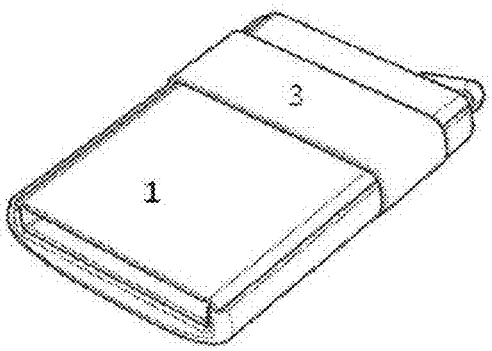

FIGS. 18 and 19 show from below and from above the closed device (the loop is not shown) in a design with rounded corners. The drawing, the specification and claims contain many features in combination. The skilled person will consider these also individually and combine them to further embodiments.

The invention claimed is:

1. An object comprising a card holder for cards and a money holder for money, wherein the card holder has a card storage space for a stack of one or more cards and the money holder has a money storage space for money, wherein the money storage space is designed such that the money is stored loosely and the money holder has in the money storage space a money access opening which, with a part of the card holder, can be closed to prevent passage of money;

wherein the card and money holder are by an elastic spring means urged towards each other; and wherein the money holder can slide parallel to the card within the card storage space to open and close the money access opening to the money storage space, wherein the elastic spring means comprises an elastic stretched elastic band as a closed loop and wherein the holders are inserted into the loop in longitudinal direction, wherein the spring means is fixed to the one holder and the other holder can slide relative to the spring means and/or the one holder, and wherein the money holder has a wall element remote from and parallel to a main wall of the money holder to between it and said main wall receive contents of the money holder, which wall element follows the movement of the money holder while it opens and closes.

2. An object according to claim 1 with a format hardly larger than a stack of 10 or 20 credit cards and configured to be stored in a pants pocket or inner pocket.

3. An object according to claim 1, wherein the money storage space has a rectangular elongated shape defining a length and a width, and wherein the wall element covers the complete width and not more than 75% of the length of the money holder.

4. An object according to claim 1, wherein the one holder retains the other holder transversely in both directions and in a single longitudinal direction by projecting wall elements.

5. An object according to claim 4, wherein the card holder and money holder are mutually independent parts that are loosely stacked mutually and are encircled by the elastic spring means.

6. An object according to claim 5, wherein the money holder has:

upright walls between which the card holder is confined at three sides; and an extending support edge at both sides onto which the card holder bears.

7. An object according to claim 6, wherein a said upright wall of the money holder provides a retaining means which engages the edge of the money access opening of the card storage space to limit sliding in a longitudinal direction.

8. An object according to claim 7, wherein the card holder has an ejector mechanism of the cards.

9. An object according to claim 1, wherein the wall element is a separate part which is fixed to the money holder and has an edge region diverting toward the card holder.

10. An object comprising a card holder for cards and a money holder for money, wherein:

the card holder has a card storage space for a stack of one or more cards and the money holder has a money storage space for money, the money storage space is designed such that the money is stored loosely and the money holder has in the money storage space a money access opening, which, with a part of the card holder, can be closed to prevent passage of money;

the card and money holder are by an elastic spring means urged towards each other;

the money holder can slide parallel to the card within the card storage space to open and close the money access opening to the money storage space;

the card and money storage space have a rectangular elongated shape defining a length of the object;

the card and money holder have a fixed shape, robust, of light weight material;

the card and money holder are mutually independent parts;

the card holder is a flat sleeve, at one longitudinal end comprising a card access opening with a card eject mechanism at the opposite end;

the card storage space receives a stack of cards with tight fit; the elastic spring means allows mutual pivoting of the card and money holder around a pivot axis which extends transverse to the length of the object and is present near an end of the object;

sliding is parallel to the length and is allowed in one direction only by restraining means at the money holder;

the card and money storage space are mutually separated by a wall of the card holder;

the longitudinal directions of the card and money storage spaces are parallel;

the elastic spring means comprises a closed loop elastic band which tightly encircles the card and money holder and extends transverse to the longitudinal direction of the card holder and is located remotely from both longitudinal ends of the money holder;

the money access opening and the card access opening to get access to the card storage space are located at the same side of the object;

the parts of the outer side of the card holder in engagement with the elastic band, are completely smooth and slippery and friction free;

the card and money holder are loosely stacked mutually and kept together merely by the elastic band which presses the card and money holder against each other by elastic tension and thus keeps them together;

the card holder is located between transverse movement preventing stops at the money holder;

the card and money holder have the top and bottom wall at fixed mutual distance;

the card and money holder have a fixed length, width and depth; the card holder has an ejector mechanism of the cards;

the card and money holder each provide an external wall of the object;

the card holder slides relative to the elastic band;

in each slide position of the card holder the card access opening is open such that a card can be inserted;

a retaining means to prevent sliding in a longitudinal direction of the card holder relative to the money holder, is present near the card and money access opening, is provided at the money holder and engages the edge of the access opening of the card holder;

the money storage space contains a plate shaped covering means parallel to the card within the card holder such that money between this means and a wall of the money holder, spaced from the card holder, is received, which covering means extends substantially the complete width of and has a length not more than 75% of the length of the money holder and is a separate part fixed to the money holder to move with the money holder and has an edge region diverting toward the card holder;

the money holder has upright walls between which the card holder is confined at three side;

the money holder has remote from its bottom wall a, parallel to the within the card holder located card, extending support edge at both sides onto which the card holder bears;

the card and money holder have a substantially equal length.

* * * * *